United States Patent [19]

Takei

[11] Patent Number: 5,002,514

[45] Date of Patent: Mar. 26, 1991

[54] TEARS-SHEDDING DEVICE FOR DOLLS

[75] Inventor: Hiroshi Takei, Tokyo, Japan

[73] Assignees: Kabushiki Kaisha Bandai; Kabushiki Kaisha Shiba, both of Tokyo, Japan

[21] Appl. No.: 468,383

[22] Filed: Jan. 22, 1990

[30] Foreign Application Priority Data

Jul. 31, 1989 [JP] Japan ..... 1-90009[U]

[51] Int. Cl.[5] ..... A63H 3/24

[52] U.S. Cl. ..... 446/305; 446/483

[58] Field of Search ..... 446/305, 304, 483

[56] References Cited

U.S. PATENT DOCUMENTS 2,811,810 11/1957 Ostrander ..... 446/305 X 3,016,651 1/1962 Brudney ..... 446/305

FOREIGN PATENT DOCUMENTS 1395589 5/1975 United Kingdom ..... 446/305

2068753 8/1981 United Kingdom ..... 446/305

*Primary Examiner*—Mickey Yu

*Attorney, Agent, or Firm*—Jordan and Hamburg

[57] ABSTRACT

A tears-shedding device for a doll includes a tank, an L-shaped opening extension disposed at the lower portion of the tank via a spherical inlet valve, for each eye of the doll a perspective convex-shaped eye extension disposed at one side of the tank via a similarly spherical outlet valve, a press pump mounted at another side of the tank, and a press mechanism for the press pump, the aforesaid opening extension being mounted in a mouth of the doll, each of the aforesaid eye extensions being mounted in a respective eye of the doll.

2 Claims, 1 Drawing Sheet

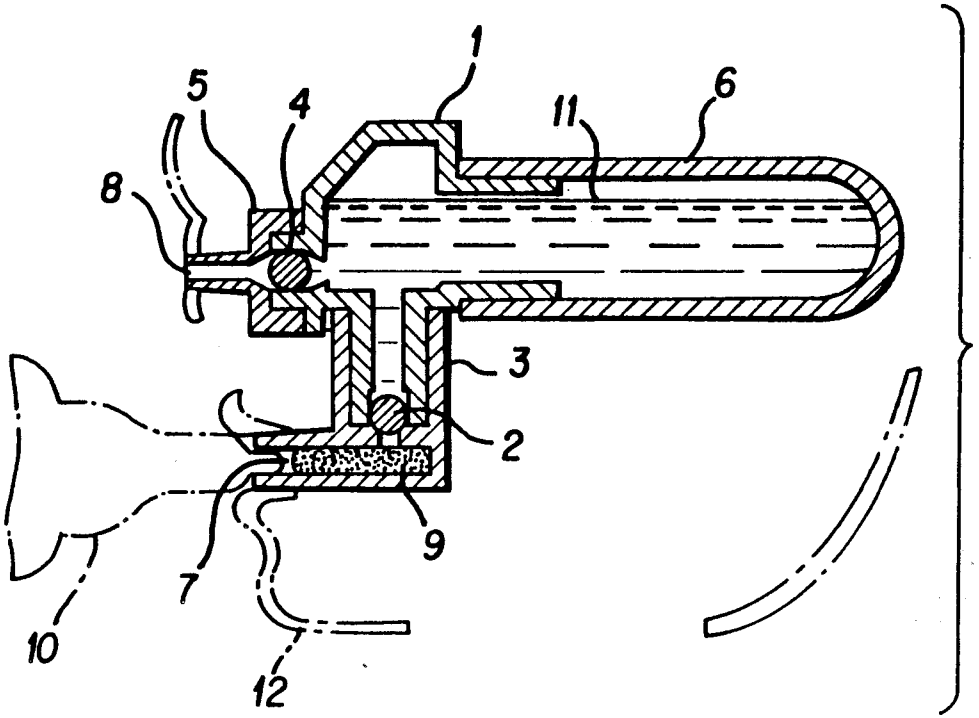
1
2
3
4
5
6
7
8
9
10
11
12

TEARS-SHEDDING DEVICE FOR DOLLS

BACKGROUND OF THE INVENTION

The present invention relates to a tears-shedding device for a doll in which water is fed to a tank through an opening and then flowed out through eyes of the doll by means of the operation of a press pump directly connected to the tank so as to display a tears-shedding state on the face of the doll.

In a conventional device for shedding tears in this technical field, a tank and a press pump are provided in a head portion of a doll, and an opening is connected to eyes through a fine tube. Water is first fed to the tank through the opening of the doll and then shed through the eyes by pressing the abdomen portion or back portion of the doll or rotating the arm of the doll.

However, in the tears-shedding portion of the eyes, no flow control means is provided and, therefore, the amount of water simulating the shedding of tears depends upon the degree of the pressing force against the abdomen portion or back portion of the doll. In particular, when it is pressed strongly, a large amount of water is shed, which wets the clothing of children playing with the doll and other nearby objects and which moreover is not realistic.

SUMMARY OF THE INVENTION

An object of the present invention is to provide a tears-shedding device for a doll by which the above-mentioned problems are solved and by which water is shed through eyes of the doll in such an amount as to ooze therethrough irrespective of the degree of pressing force applied to a press pump.

According to the present invention, there is provided a tears-shedding device for a doll characterized by comprising a tank, an L-shaped opening extension disposed at the lower portion of the tank via a spherical inlet valve for each eye of the doll a respective shaped eye extension disposed at one side of the tank via a similarly spherical outlet valve, a press pump mounted at another side of the tank, and a press mechanism for the press pump, the aforesaid opening extension being mounted in a mouth of the doll, each aforesaid eye extension being mounted in a respective eye of the doll.

The thus constituted tears-shedding device for the doll is used as follows: Water is first fed from a feeding bottle to the tank through the opening. In this case, the inlet valve is raised by water pressure and water is forwarded through a space and then stored in the tank and the press pump which is directly connected to the tank.

Afterward, when a press mechanism, for example, an arm is rotated, a crank wheel is then rotated in order to press a side portion of the press pump, so that the water in the tank is pressed. In consequence, the inlet valve is closed and the outlet valve is pressed, and as a result, a small amount of water oozes through a space and the eyes.

BRIEF DESCRIPTION OF THE DRAWING

The drawing is a sectional view of a tears-shedding device for a doll in which a press mechanism is omitted.

DETAILED DESCRIPTION OF THE INVENTION

Now, the present invention will be described in detail by way of an embodiment as illustrated in the drawing.

The drawing is a sectional view of a tears-shedding device for a doll in which a press mechanism is omitted.

In this drawing, an L-shaped opening extension 3 is disposed at the lower portion of a tank 1 via a spherical inlet valve 2, and for each eye of the doll a respective convex-shaped eye extension 5 is disposed at one side of the tank 1 via a similarly spherical outlet valve 4. A press pump 6 made from a synthetic resin is mounted at the other side of the tank 1. The opening extension 3 is mounted in a mouth 7 of a doll, and each eye extension 5 is similarly mounted in a respective eye of the doll. Furthermore, a press mechanism (not shown) is operatively associated with the press pump 6. In an end portion of the opening extension 3, a water absorbent material 9 made from urethane or the like is disposed.

As the press pump 6, a bellows type pump can be used in addition to a plunger type pump made from a flexible resin shown in the drawing. As a press mechanism, there can be employed a means for connecting a known arm to a crank wheel and pressing the press pump by rotating the arm, or a means for pressing an end portion of the bellows type pump with a rod extending from an abdomen or back portion of the doll. In short, any means is acceptable, so long as it can perform pressing and releasing of the press pump 6 repeatedly in order to accomplish the same purpose. Reference numeral 12 denotes the doll a part of which is shown in the drawing.

When fed from a feeding bottle 10 or the like to the opening extension 3, water rises through the water absorbent material 9 and the inlet valve 2, and it is then stored in the tank 1 and in the press pump 6 which is connected to the tank 1.

Afterward, the press pump 6 is pressed by the press mechanism of the above-mentioned press means, so that the pressed water 11 in the press pump 6 and the tank 1 presses the outlet valve 4, with the result that a small amount of the water oozes through a little space between the inner end wall of the eye extension 5 and the outlet valve 4. This function is carried out stably irrespective of the degree of pressing force applied to the press pump 6.

At this time, the spherical inlet valve 2 is closely brought into contact with the inner wall of a water passage so as to prevent water from flowing backward. Excess water in the water passage leading to the spherical inlet valve 2 is absorbed by the water absorbent material 9 in order to prevent the water from flowing out through the opening 7. When the pressing of the press pump 6 is released, the outlet valve 4 is sucked in order to close an outlet, so that the water which has been discharged once as the tears do not flow backward through the eyes 8.

In the present invention, spherical inlet and outlet valves are used, and therefore a certain amount of water can be allowed to ooze through eyes of a doll with every press operation irrespective of the degree of pressing force against a press pump. Thus, the state that the doll begins to weep can be displayed realistically. Since the tear water is allowed to ooze in a small amount, clothes of children and nearby objects can be protected from the tear water, and the tears-shedding operation is possible for a long time, even if the volume of a tank is small.

What is claimed is:

1. The combination of a doll having eyes and a mouth and a tears-shedding device for the doll, comprising a tank positioned behind the eyes of the doll, an L-shaped inlet conduit for supplying water to the tank from an external source, the inlet conduit having one open inlet end positioned in the mouth of the doll for receiving water from the external source and an open outlet end communicating with the tank, an inlet ball valve in the inlet conduit for permitting flow of water through the conduit only in the direction from the inlet end thereof to the outlet end thereof, a pump for pumping water out of the tank, for each of the eyes a respective outlet conduit communicating between the tank and a respective eye of the doll, the outlet conduit having an open inlet end communicating with the tank and an open outlet end communicating with the eye, and a respective outlet ball valve in each respective outlet conduit for responding to operation of the pump by permitting flow of water through the outlet conduit only in the direction from the tank to the eye, a chamber formed in the outlet conduit, the chamber having a dimension in the axial direction of the outlet conduit only somewhat greater than the diameter of the ball of the outlet ball valve and seats for the ball of the outlet ball valve formed at opposite upstream and downstream ends of the chamber so that each pulse of pressure produced by operation of the pump moves the ball of the outlet ball valve from the upstream seat in the chamber to the downstream seat in the chamber whereafter the ball of the outlet ball valve returns to the upstream seat so that the flow of water through the outlet conduit is metered, the size of the chamber being such that the water oozes through the outlet conduit at a rate suitable to simulate tears regardless of the force applied to the pump.

2. THe combination according to claim 1, further comprising a water absorbent material located in the inlet conduit between the inlet opening thereof and the inlet ball valve to absorb residual water in the inlet conduit upstream from the inlet ball valve upon termination of the feeding of water into the inlet conduit from the external source.

* * * * *